US006663937B2

(12) United States Patent
Ullman et al.

(10) Patent No.: US 6,663,937 B2
(45) Date of Patent: Dec. 16, 2003

(54) UNIVERSAL MAT WITH REMOVABLE STRIPS

(76) Inventors: Myron Ullman, 120 Sleepy Hollow Dr., Canfield, OH (US) 44406; M. Robert Burman, 10511 Willowbrook Dr., Potomac, MD (US) 20854; Ronald N. Kessler, 5354 Logan Arms Dr., Girard, OH (US) 44420

( * ) Notice: Subject to any disclaimer, the term of this patent is extended or adjusted under 35 U.S.C. 154(b) by 0 days.

(21) Appl. No.: 09/990,248

(22) Filed: Nov. 21, 2001

(65) Prior Publication Data

US 2002/0031639 A1 Mar. 14, 2002

Related U.S. Application Data

(60) Division of application No. 09/898,304, filed on Jul. 3, 2001, which is a continuation-in-part of application No. 09/274,360, filed on Mar. 23, 1999, now abandoned.

(60) Provisional application No. 60/079,120, filed on Mar. 23, 1998.

(51) Int. Cl.[7] ..... B32B 3/10

(52) U.S. Cl. ..... 428/100; 428/99; 428/54; 15/215; 15/217

(58) Field of Search ..... 428/54, 67, 95, 428/100, 99, 137; 15/215, 217; 52/177, 181

(56) References Cited

U.S. PATENT DOCUMENTS

| | | | |
|---|---|---|---|
| 1,483,095 | A | 2/1924 | Kain |
| 2,070,839 | A | 2/1937 | Place |
| 3,158,962 | A | 12/1964 | Faase |
| 3,703,059 | A | 11/1972 | Kessler |
| 3,742,671 | A | 7/1973 | Ellis |
| 3,808,628 | A | 5/1974 | Betts |
| 3,846,945 | A | 11/1974 | Roby |
| 4,029,834 | A | 6/1977 | Bartlett |
| 4,143,194 | A | 3/1979 | Wihksne |
| 4,167,599 | A | 9/1979 | Nissinen |
| 4,361,614 | A | 11/1982 | Moffitt, Jr. |

(List continued on next page.)

FOREIGN PATENT DOCUMENTS

| | | |
|---|---|---|
| DE | 44 07 231 A1 | 9/1995 |
| DE | G 87121 32.8 | 2/1998 |
| EP | 0 059 886 A1 | 9/1982 |
| EP | 0 289 880 A2 | 4/1988 |
| EP | 0 289 880 A2 | 11/1988 |
| EP | 0 359 478 A2 | 3/1990 |
| EP | 676 169 A1 | 10/1995 |
| EP | 1 038 493 A2 | 9/2000 |
| GB | 2 066 061 A | 7/1981 |
| GB | 2 136 472 A | 9/1984 |
| WO | WO 96/36268 | 11/1996 |

OTHER PUBLICATIONS

Verimpex Entrance Matting Systems Catalog—4 pages—document is undated but inventor believes the document is older than Mar. 22, 1997.

(List continued on next page.)

*Primary Examiner*—Alexander S. Thomas
(74) *Attorney, Agent, or Firm*—Sand & Sebolt

(57) ABSTRACT

A rubber or plastic floor mat has a series of parallel upper ribs (130) on its upper surface which define slots (110) in which respective strips (10) or carpeting or the like are removably held. The strips are retained along their lengths by retaining means which run continually or continuously along the slots. The strip retainers include hook-and-loop fastening (e.g., VELCRO), and/or overhanging edges above the strip edges, preferably formed in one-piece fashion along the side of the upper ribs adjacent the slots. The overhangs may be interrupted, e.g., crenelated as seen from above, and may include bevels.

34 Claims, 3 Drawing Sheets

U.S. PATENT DOCUMENTS

| | | | |
|---|---|---|---|
| 4,361,925 | A | 12/1982 | Yamamoto et al. |
| 4,415,620 | A | 11/1983 | Yamazaki et al. |
| 4,468,910 | A | 9/1984 | Morrison |
| 4,727,697 | A | 3/1988 | Vaux |
| 4,796,399 | A | 1/1989 | Kessler et al. |
| 4,798,029 | A | 1/1989 | Carlton |
| 4,822,658 | A | 4/1989 | Pacione |
| 4,877,672 | A | 10/1989 | Shreiner |
| 4,963,054 | A | 10/1990 | Hayashi |
| 5,191,692 | A | 3/1993 | Pacione |
| 5,323,575 | A | 6/1994 | Yeh |
| 5,403,637 | A | 4/1995 | Pickard et al. |
| 5,486,392 | A | 1/1996 | Green |
| 5,509,244 | A | 4/1996 | Bentzon |
| 5,628,160 | A | 5/1997 | Kung |
| 5,882,764 | A | 3/1999 | Kessler et al. |
| 5,958,538 | A | 9/1999 | Kessler |
| 6,042,915 | A | 3/2000 | Kessler |
| 6,068,908 | A | 5/2000 | Kessler et al. |
| 6,127,015 | A | 10/2000 | Kessler |

OTHER PUBLICATIONS

Nuway Entrance Matting Catalog—8 pages—document is undated but inventor believes the document is older than Mar. 22, 1997.

Nuway Matting Systems, Inc. Catalog—7 pages—document is undated but inventor believes the document is older than Mar. 22, 1997.

Front Runner Matting Catalog—3 pages—Mar. 1994.

Hi–Rib Rubber Mats Catalog—1 page—document is undated but inventor believes the document is older than Mar. 22, 1997.

Verimpex Entrance Matting Catalog—10 pages—document is undated but inventor believes the document is older than Mar. 22, 1997.

Vina–Cir Catalog—4 pages—document is undated but inventor believes the document is older than Mar. 22, 1997.

DeCoir Ti–Grid System Catalog—9 pages—Oct. 1, 1983.

Flexigrid Catalog—2 pages—document is undated but inventor believes the document is older than Mar. 22, 1997.

Ancillaries Price List—1 page—document is undated but inventor believes the document is older than Mar. 22, 1997.

Front Runner Matting Catalog—May 1994.

UNIVERSAL MAT WITH REMOVABLE STRIPS

CROSS REFERENCE TO RELATED APPLICATION

This application is a divisional application of U.S. application Ser. No. 09/898,304, filed Jul. 3, 2001, now pending, which is a continuation-in-part application claiming priority from U.S. application Ser. No. 09/274,360, filed Mar. 23, 1999 abandoned, which claims priority from provisional application Ser. No. 60/079,120, filed Mar. 23, 1998; the contents of these applications are entirely incorporated herein by reference.

FIELD OF THE INVENTION

The present invention relates to floor mats.

REVIEW OF THE RELATED TECHNOLOGY

In the past, floor mats were made for specific purposes. Mats were made for entrance ways, commercial kitchen fatigue mats, oil resistance, snow and water removal, etc. Most of the above uses required specific mat constructions to perform whatever use was required. Sometimes it took more than one supplier to provide all of the requirements. If one mat supplier tried to cover the field, the investment in machinery, people, and skills made it very expensive to react to the demand. Warehousing alone was expensive in order to have the specific purpose product on demand.

Known floor mats, for example as shown in U.S. Pat. Nos. 3,703,059 and 4,796,399 to Kessler et al, include a framework formed of crossing ribs attached to one another at the crossing points. The ribs are usually made of plastic and are either welded together or are integrally molded in one piece. The ribs cross at right angles, with the lower tier of ribs resting on the floor.

Mats of the type shown in Kessler USP '399 have included carpet strips held between pairs of adjacent upper ribs. The carpet strips are typically formed with a thermoplastic backing from which bundles of fibers extend. The plastic backing of the strip is adhered to the top sides of the lower ribs where it passes over them, or is attached by clips.

These mats have many advantages for use where people's shoes may be quite muddy or wet, and also provide anti-fatigue support. The areas between the carpet strips let water drain down into the space between the lower tier of ribs on the floor, keeping the carpeting relatively dry and avoiding puddling on the carpet itself. The mats are low in cost as compared to carpeting.

It would be a tremendous advantage if a mat could be provided which could be stocked in an intermediate condition and then finished when the requirements from the field were requested. But this is not possible with the previously known mats in which the carpet strips are substantially permanently fixed, i.e. are either not removable at all without destroying the mat or are removable only with considerable difficulty. This means that the carpet strips cannot be taken out easily for cleaning or replacement, and they cannot be placed in arbitrary patterns of color or type to match particular applications, and they cannot be replaced by other types of strips, e.g. abrasive strips, slit tire casing strips, hardwood flooring strips, decorative vinyl or other types of flooring strips, etc., depending on the purchaser's requirements or wishes.

SUMMARY OF THE INVENTION

Accordingly, the present invention has an object, among others, to overcome deficiencies in the prior art such as noted above.

The present invention thus provides a backing framework for a floor mat having anti-fatigue properties and also having slots in which various types of strips can be fastened, making the strips removable and replaceable.

In a first embodiment of the present invention, the edge of the carpet strip or other surfacing strip protrudes slightly and fits into side grooves which partly define the slit, which is preferably formed between the upper surfaces of the lower ribs and an overhanging edge running alongside of the upper ribs on each side of the carpet strip.

A similar embodiment is described and illustrated in prior provisional application Ser. No. 60/079,120, filed Mar. 23, 1998. Unlike the embodiment illustrated in Ser. No. 60/079,120, the overhanging edge or protrusion is interrupted or tooth-like, i.e. there are interruptions of the overhanging edge along the direction of the strip. The overhanging edge, when viewed from above, has a generally crenelated or square-wave shape.

Preferably, the shape of the overhanging edge is also different from that shown in application Ser. No. 079,120. In the '120 application the cross section of the overhang, taken on a plane perpendicular to the extension of the strips, is triangular. In the present invention the preferred shape of the corresponding cross section is a rectangle, optionally with the lower corner beveled on the side facing the strip. Most preferably, it comprises an extension of the upper ribs of the mat running in the same direction as the strips and edges.

In a second embodiment, the carpet strip and the bottom of the slot are lined with many upstanding hook-like projections of the type which appear in hook-and-loop fastening strips, such as the type sold under the name VELCRO, which projections adhere the bottoms of the strips to the slots. The hooks are preferably formed on the upper surface of a plastic strip and the strip is adhered to the bottom of the slot of the backing framework. The loop material, which can simply be cloth, forms (or is adhered to) the bottom of the carpet strip. Thus, the carpet strips can be simply peeled out of the slots when they require replacement or cleaning. Since the hook material is covered at all times during use, the hooks are not damaged and remain usable for a long time.

The invention contemplates all combinations of the features of the two embodiments discussed above (and also all those of application Ser. No. 60/079,120), for example a combination of the overhanging edge or protrusion with the hook-and-loop fastening.

The strips can be arranged in arbitrary patterns of color, texture, or material. Also, various types of inserts with loop material adhered to the bottom thereof can be used in various combinations. For example, in place of the usual plastic/fiber bundle carpet strips, wooden strips can be used; this will greatly increase the attractiveness of the mat. Strips can be easily changed to suit various conditions.

The lower ribs can optionally be made thinner under the carpet strips. The backing or framework is much less stiff across the strip insertion direction and provides good anti-fatigue properties.

BRIEF DESCRIPTION OF THE DRAWING

The objects, nature, and advantages of the present invention will be apparent from the following description of an embodiment taken in conjunction with drawings, wherein.

DETAILED DESCRIPTION OF THE PREFERRED EMBODIMENT

Figure 1:
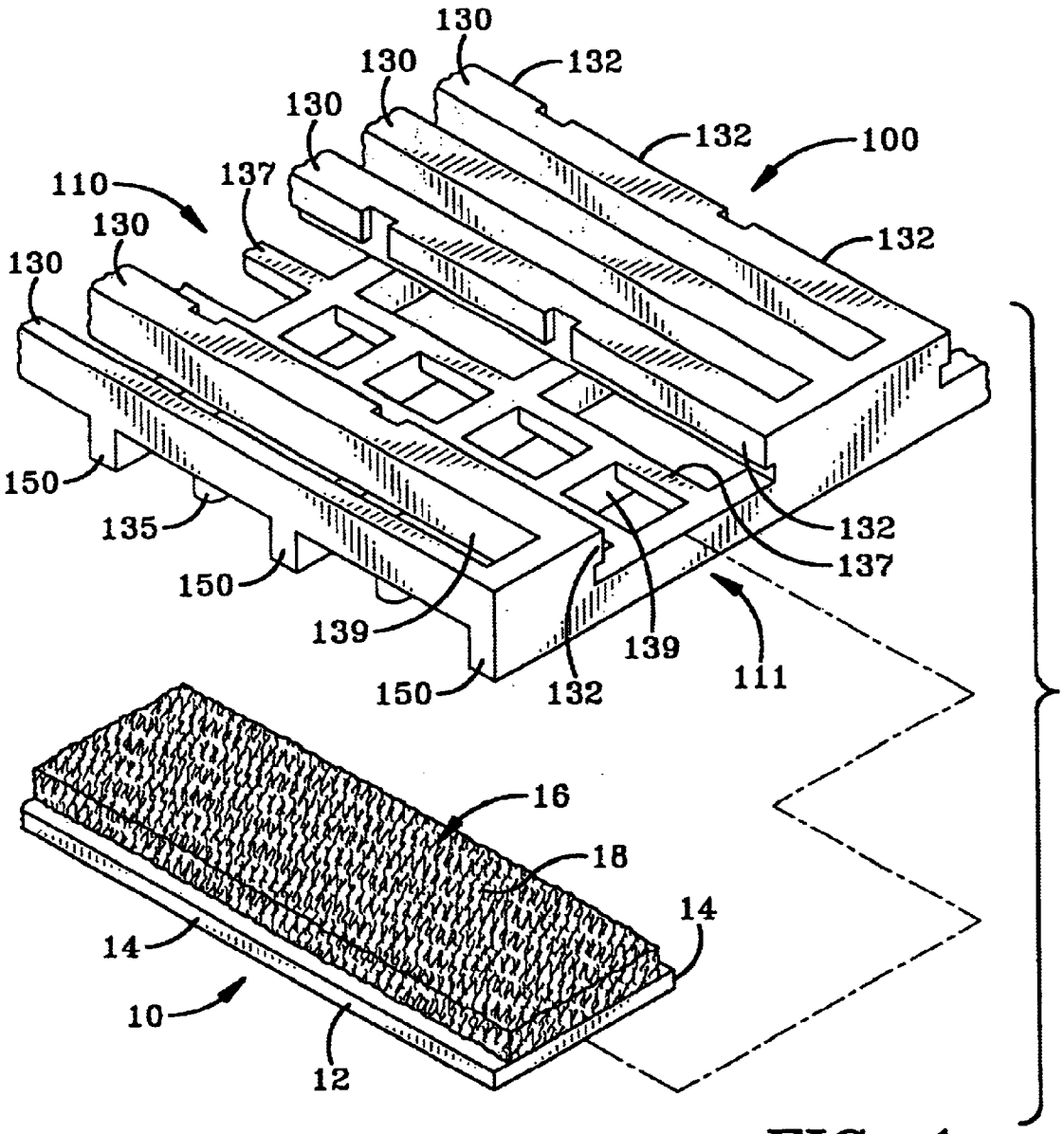
FIG. 1 is an exploded perspective view of a first embodiment of the invention.

The reference numerals follow those of provisional application Ser. No. 60/079,120.

FIG. 1 shows a carpet strip 10 with a rigid or semi-rigid backing strip 12 made of plastic or rubber. The strip 10 has two opposed edges 14 and a central area 16 with embedded carpet fibers 18.

The strip 10 slides into a slot 110 of a backing or framework 100 as indicated by the dashed lines. The edges 14 are held in side grooves defined by overhangs or protrusion portions 132 extending into the slot 110 from a pair of adjacent but separated upper ribs 130.

The framework 100 has two major structural parts, the parallel upper ribs 130 running in one direction and lower ribs 150 running in a transverse direction to the upper ribs 130, preferably at 90° from one another. The lower surfaces of the lower ribs 150 rest on the floor (not shown) and the upper surfaces of the upper ribs 130 are at the walk-on surface level. The framework 100 is preferably molded of semi-rigid plastic or rubber as one unit, but the upper ribs 130 and the lower ribs 150 can also be welded or otherwise fastened together from discrete elongated (e.g. extruded) stock to make up the framework. The preferred stock pieces are of plastic, e.g. PVC, polyester, nylon, polyolefin, TPR, urethane, or any other plastic, with a rectangular cross-section, and may be hollow (e.g. round, partly curved or square-section tubing).

In the preferred embodiment the space at the bottom of the slot 110 is reinforced with braces 137 which run between lower ribs 150, parallel to the upper ribs 130. These preferably have a lesser cross-sectional area than the ribs 130.

The braces 137 are placed close to the protrusion portions 132 so that the edges 114 of the strip 10 are firmly held, in the vertical direction, between the braces 137 and the protrusion portions 132.

Molded-in blocks 139 may bridge between the braces 137. Extending from the floor level to the bottom of the slot 110, they provide additional support when someone walks on the carpet strip 10 after it is inserted into the slot 110. Similar support may be provided by posts 135 extending to the floor level from the undersides of the upper ribs 130 where they span across a gap between two lower ribs 150.

The end opening 111 of the slot 110 is open to receive the carpet strip 10. At the other end of the mat (not shown in FIG. 1) the lower portion of the end corresponding to opening 111 is blocked, up to the height of the top of the inserted backing strip 12, by a molded-in slot end stop wall. The stop wall may optionally extend upward to the upper surface of the upper ribs 130. With the slot end stop wall, the inserted end of the strip 10 cannot pass out of the slot 110 past the other side (not shown) of the mat framework 100. This makes strip alignment during insertion easier and prevents the strips from working out in at least one direction.

Unlike the embodiment illustrated in Ser. No. 60/079,120, the embodiment of FIG. 1 has interruptions in the protrusion portions 132, so that viewed from above it appears to be crenelated on either side of the slot.

Figure 4:
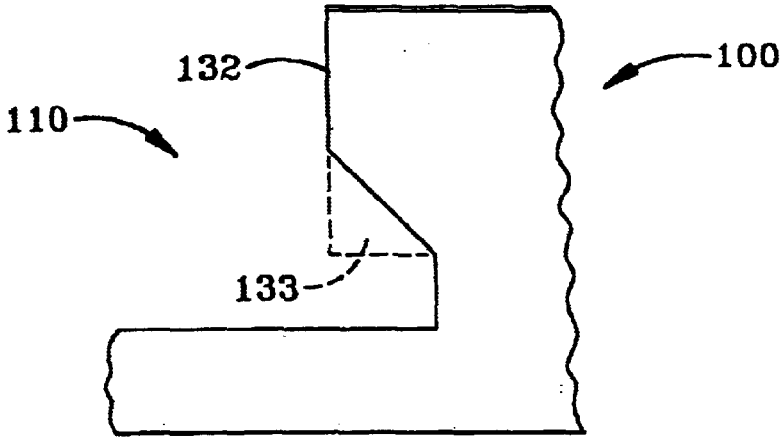
FIG. 4 is a broken elevational view illustrating a bevel on the underside of the overhang or protrusion.

The protrusion portions 132 may be of any cross-sectional shape, as viewed along the length of the slot 110. Preferably, they are rectangular as shown. Different portions may be of different shapes. One of the preferred embodiments is shown in FIG. 4. The protrusion portions may have any width in the horizontal direction perpendicular to the extension of the strip. Preferably they extend, horizontally into the slot 110, not quite to the nearest edge of the adjacent brace 137. This leaves a small gap between the overhang or protrusion 132 and the brace 137, through which the floor may be seen when the strips 10 are absent. This gap provides clearance for downward-extending portions of a clip 30, as discussed below.

FIG. 4 shows a portion of the mat 100 as seen looking along the slot 110. The overhanging edge or protrusion 132 includes a bevel 133, and lacks the square lower corner which is shown in FIG. 1 and is indicated in FIG. 4 by dashed lines.

Preferably, as shown in FIG. 1, the length of each protrusion portion 312 is roughly equal to the spacing of the lower ribs 150, but the portions 132 may be of any fixed length, of variable length, of random length, of lengths according to a mathematical pattern, and so on.

Preferably also the interruptions, where any protrusion portion 132 is lacking, coincide with the lower ribs 150. They may be of any length, but preferably are at least as long as the width of the lower ribs 150. Thus, the protrusions preferably are not staggered in the preferred and illustrated embodiment. The present invention contemplates any shapes, spacing, or other characteristic of the protrusion portions 132.

The crenelated protrusion portions 132 allow the carpet strip to be more easily inserted and removed. If the strip 10, and/or its edges 14, are not excessively stiff then the strip 10 can be inserted from above. If the portions of the protrusion portion 132 are staggered, insertion may be easier. The present invention also contemplates strips 10 with crenelated edges, whereby the strip 10 may be more easily inserted from above and then slid along the slot 110 to lock in place.

Figure 2:
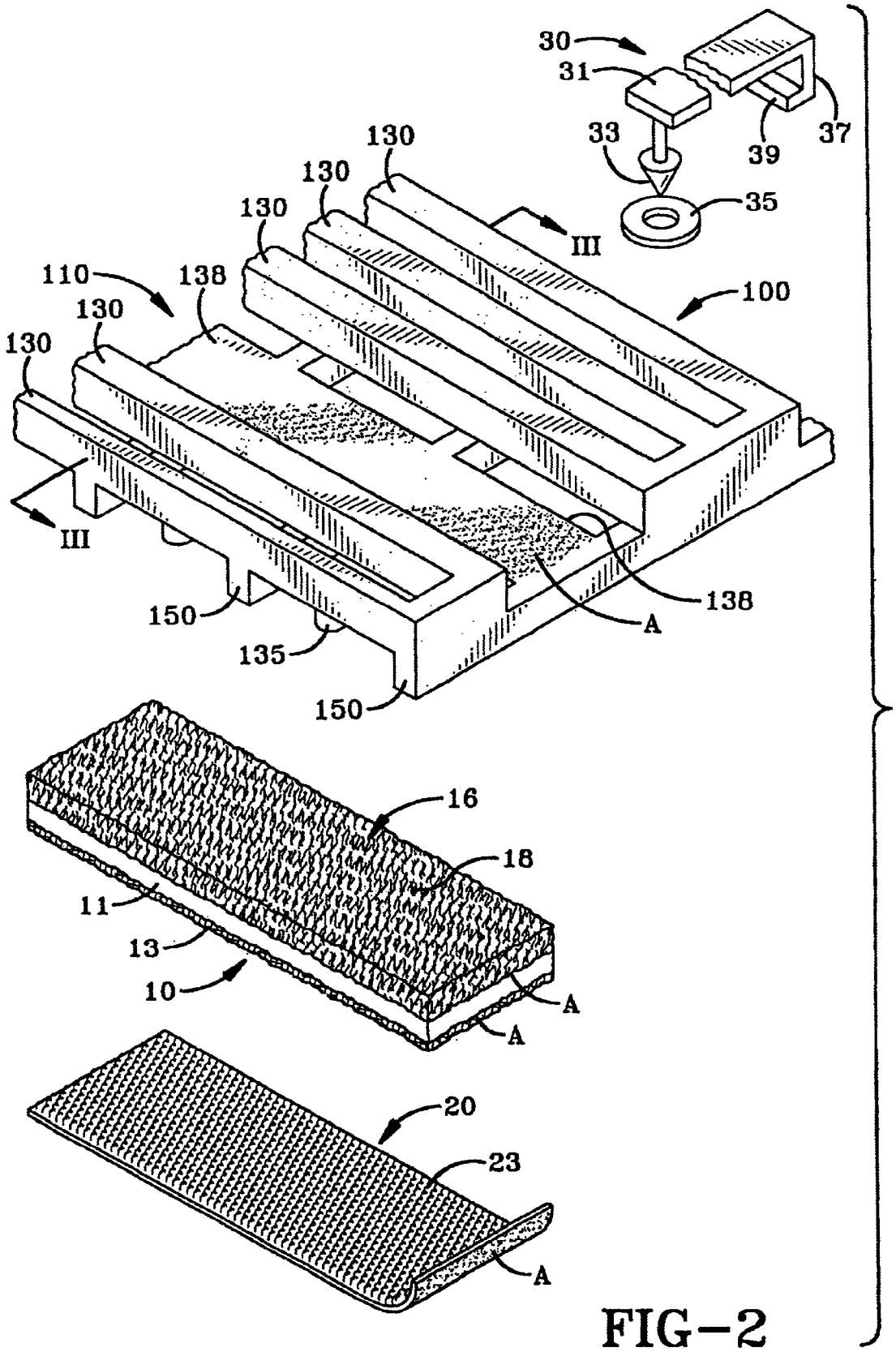
FIG. 2 is an exploded perspective view of a second embodiment of the invention.

FIG. 2 shows a second preferred embodiment of the present invention. The mat framework 100 is similar to that of FIG. 1 except that the protrusion portions 132 are preferably omitted. The upper surface of the mat, which ends up under the strip 10, is preferably bridged over between the braces 137 to form a wider surface 138 on which may be spread an adhesive A (indicated by stippling). The blocks 139, though not shown in FIG. 2, may optionally be retained. The structure may be like that of FIG. 1 except that a thin (e.g. 2 mm or 1/16 inch) layer bridges between the various stiffening members. The structure including the area 138 is preferably one-piece, for example, all molded at once of plastic.

The layer of adhesive A of any type for holding in place a strip of hook material 20 having hooks 23 on one side. The underside of the strip of-hook material 20 may also (or alternatively) be covered with the same adhesive A as on the surface 138 (or a different adhesive), for the purpose of permanently or semi-permanently attaching the strip 20 in the bottom of the slot 110. In FIG. 2 the strip 20, which is preferably flexible and formed integrally of plastic, is shown outside the slot 110 for clarity, but the present invention contemplates that the mat includes strips 20 in each slot 110. The strip 20 is shown fastened in place in FIG. 3.

Alternatively, the upper surface of the braces 137 and blocks 139 may include hooks molded or formed directly into the preferably plastic material of the mat 100, or hooks inserted into the slot surface in the manner of toothbrush bristles. The mat 100 may omit the lower ribs 150.

FIG. 2 also shows a carpet strip 10 which includes on a lower side, opposite the carpet fibers 18, a strip 13 of loop material, felt, or other stuff that the hooks 23 can grip. The grip strip 13 is preferably fastened to the strip 10 by adhesive A. Preferably, an additional intermediate layer 11 of foam rubber or the like is fastened between the grip strip 13 and the carpeting 18. The intermediate layer may provide resilience, liquid absorption, additional carpet strip height, and so on.

Figure 3:
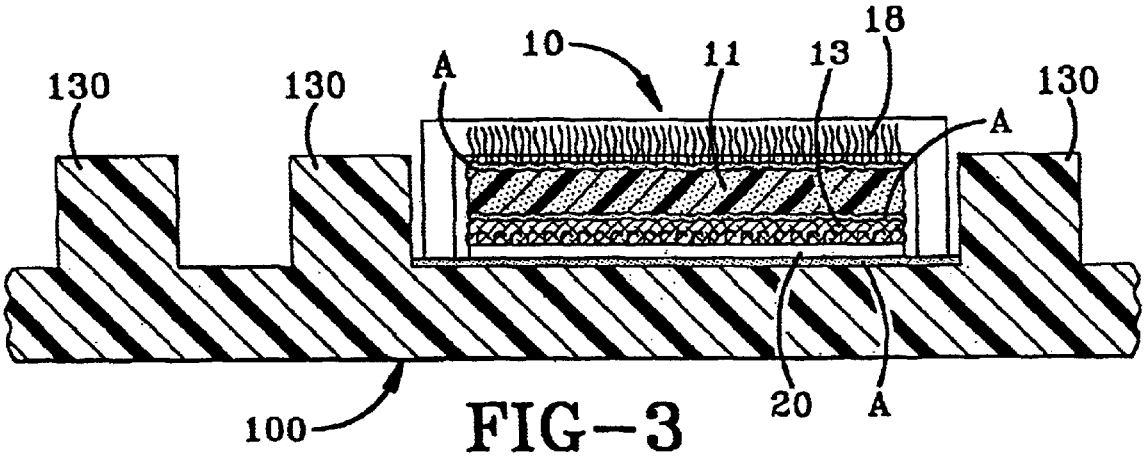
FIG. 3 is a cross-sectional view taken on section III—III of FIG. 2.

When laid onto the hook strip 20, the carpet strip 10 will immediately hold firmly to the mat framework 100 because of its grip strip 13. The adhesive A or other fastening means preferably holds the strip 20 to the mat 100 with strength greater than the strength of hook-and-loop fasteners, so the flexible carpet strip 10 can be removed simply by peeling up one end and pulling it. FIG. 3 shows the carpet strip held in the slot 110 of the mat 100.

FIG. 3 is a cross-sectional view taken transverse to the upper ribs 130 and through the length of one of the lower ribs 150 (not shown in FIG. 3). FIG. 3 alternatively represents a mat lacking the crossed-beam construction with lower ribs 150, i.e. FIG. 3 might represent a uniform cross-section of an alternate embodiment of the mat 100.

FIG. 2 shows two embodiments of a clip 30 in broken view or partial view, with one embodiment on the left and one on the right. The clip 30 prevents unintended pulling-up of the ends of the carpet strip 10, using a hold-down crosspiece 31 which bridges over the carpet strip 10. The best place for the clip 30 is near the end of the strip. In one embodiment both ends of the clip 30 include the puncturing arrow 33 shown on just the left end of the illustrated clip of FIG. 2. A mating stop or washer 35 is optionally provided to cooperate with the arrow 33. After the strip 10 is in place, the clip 30 is pressed downward until the arrows 33 penetrate the strip 10. Then the stops 35 can be forced over the arrows 33 from the underside of the mat 100. The arrows 33 may pass through the mat in the small gap between the overhang or protrusion 132 and the brace 137, or, some other space. Optionally, the arrows may also penetrate the mat.

Figure 5:
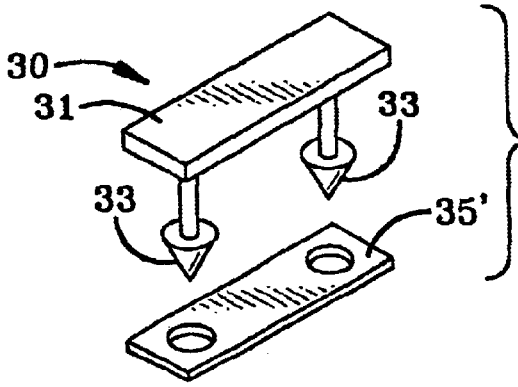
FIG. 5 is a perspective view of a Tinnerman clip.

FIG. 5 shows an slightly different embodiment of the stop 35, a "Tinnerman clip" 35', which combines the two stops 35 into a single elongated piece with two holes. is also pressed over the arrows 33. The Tinnerman clip 35' bridges over the undersides of the braces 137, locking the strip 10 against the braces 137 and into the slot 110. The washers 35 perform similarly.

Alternatively, the braces 137 may include holes for the arrows 33. Another other means of fastening the clips is within the scope of the invention.

The other embodiment of the clip 30 has two downward extensions 37 of the crosspiece 31 and two inward extensions 39 (only one of each is shown in FIG. 2, on the broken right side of the clip 30; FIG. 3 shows a complete clip 30 with two downward extensions 37, one on either side. The inward extensions 39 are not visible in FIG. 3). The inward extensions 39 optionally snap under the surface 138 of the mat 100, or the braces 137, locking the strip 10 in place. The inward extensions 39 may also be crimped into place or formed by bending the downward extensions 37 inward after they are inserted past the undersurface of the mat 100, and over the undersides of the braces 137. The clip 30 may be of any material.

FIG. 3 shows the clip 30 its mounted position as described above. The clips 30 may be removed prior to removing the strip 10.

As long as the removable strip 10 is even moderately flexible, it will be possible to peel it out of a slot 110 for cleaning or any other reason once the clips 30 are removed. The present invention therefore provides great flexibility in using the mat for different functions in a variety of situations. Besides carpet, the strips 10 can include any other flexible material (or more rigid materials, especially if they are notched perpendicular to their length in the embodiment of FIG. 1); they may include abrasive strips, and may alternate strips of different materials. The mat may be provided in lengths of 4 to 8 ft. to adequately brush the shoe bottom dry. Where appearance is more important, decorative strips can be used, e.g. strips with slots, decorative vinyl strips, etc.; or any combination of the above strips can be used to achieve a particular objective.

The mats may also be assembled in sections, as is disclosed in U.S. Pat. Nos. 5,958,538 and 5,882,764, the contents of which are entirely incorporated herein by reference. Preferred dimensions of the sections are 18" by 24" or 26", which can be assembled into sizes such as 3 feet square, 4 feet square, 4 feet by 4 and ½ feet, or 6 feet by 3 feet.

Instead of the adhesive or adhesives A disclosed above, the various parts of the present invention may be attached with fasteners (e.g. rivets or staples), may be welded together (e.g. ultrasonic welding), or may be fastened by any other means.

An alternative construction contemplates reversing the hooks and loop or felt, so that the mat or backing 100 would include the loop layer and not the hook layer.

Any sort of elongated strip retainer or means for removably holding the strips 10 in the mat 100 is within the scope of the invention, and not just the preferred embodiments of elongated retainers including the protrusions 132, the hook-and-loop fastening system, and combinations of those.

The present invention differs from previous inventions in that the strips 10 can be inserted into the slots 110 and also removed from above the mat 100, by pressing or pulling. In the embodiment in which the overhanging edge or protrusion 132 includes a bevel 133, the strip 10 requires less force to be removed than inserted when the bevel 133 is on the inside lower corner, as illustrated in the drawing. This is useful because less force can be applied in pulling (e.g., with fingers) than in inserting (e.g., by leaning on an stick). (If the bevel is alternatively on the inside upper corner—this is not illustrated—then the strip 10 will be relatively more difficult to remove and easier to insert.)

The framework 100 is considered to be a "flow-through mat" configuration because ribs 130 and 150 define a plurality of openings 200 that allow water and debris to fall through framework 100. The invention also provides drain openings 202 that allow water to drain from slots 110.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

What is claimed is:

1. A floor mat system, comprising:

a mat having an upper surface;

at least one strip removably and re-attachably connected to the mat; a section of hook fasteners connected to one of the mat and the strip and a section of loop fasteners connected to the other of the mat and the strip; the hook and loop fasteners providing the removable and re-attachable connection between the strip and the mat;

the mat defining a slot; the strip being at least partially disposed in the slot;

the mat including a plurality of spaced apart upper ribs disposed substantially parallel to the slot; a plurality of spaced apart lower ribs disposed substantially perpendicular to the slot; and at least one brace disposed substantially parallel to the slot; the upper surface of the brace defining a portion of the slot; and the at least one brace has a thickness and each of the lower ribs has a thickness; the thickness of the brace being less than the thickness of the lower ribs; and each of the lower ribs having an upper surface; the upper surface of a portion of the lower ribs cooperating with the brace to define a portion of the slot.

2. The system of claim 1, wherein the mat defines at least one drain opening adapted to allow liquid to drain out of the slot.

3. The system of claim 2, wherein the mat defines a plurality of drain openings adapted to allow liquid to drain out of the slot.

4. The system of claim 1, wherein the mat defines a plurality of slots; the system including a strip removably and re-attachably connected to the mat in each slot.

5. The system of claim 4, wherein hook and loop fasteners provide the removable and re-attachable connection between the strips and the mat.

6. The system of claim 4, wherein the strips are parallel.

7. A floor mat system, comprising:

a mat having an upper surface;

at least one strip removably and re-attachably connected to the mat; a section of hook fasteners connected to one of the mat and the strip and a section of loop fasteners connected to the other of the mat and the strip; the hook and loop fasteners providing the removable and re-attachable connection between the strip and the mat;

the mat defining a slot; the strip being at least partially disposed in the slot;

the mat including a plurality of spaced apart upper ribs disposed substantially parallel to the slot; a plurality of spaced apart lower ribs disposed substantially perpendicular to the slot; and at least one brace disposed substantially parallel to the slot; the upper surface of the brace defining a portion of the slot; and the at least one brace has a thickness and each of the lower ribs has a thickness; the thickness of the brace being less than the thickness of the lower ribs; and at least one block connected to the brace; each of the at least one block extending from the side of the brace.

8. A floor mat system, comprising:

a mat having an upper surface;

at least one strip removably and re-attachably connected to the mat; a section of hook fasteners connected to one of the mat and the strip and a section of loop fasteners connected to the other of the mat and the strip; the hook and loop fasteners providing the removable and re-attachable connection between the strip and the mat;

the mat defining a slot; the strip being at least partially disposed in the slot;

the mat including a plurality of spaced apart upper ribs disposed substantially parallel to the slot; a plurality of spaced apart lower ribs disposed substantially perpendicular to the slot; and at least one brace disposed substantially parallel to the slot; the upper surface of the brace defining a portion of the slot; and the at least one brace has a thickness and each of the lower ribs has a thickness; the thickness of the brace being less than the thickness of the lower ribs;

the mat defining a plurality of drain openings adapted to allow liquid to drain out of the slot; and the strip being disposed intermediate two drain openings when the strip is disposed in the slot.

9. The system of claim 8, wherein the strip has a first width; the slot having a second width; the second width being greater than the first width.

10. A floor mat system, comprising:

a mat having an upper surface;

at least one strip removably and re-attachably connected to the mat;

the mat defining a slot; the strip being at least partially disposed in the slot;

the mat including a plurality of spaced apart upper ribs disposed substantially parallel to the slot; a plurality of spaced apart lower ribs disposed substantially perpendicular to the slot; and at least one brace disposed substantially parallel to the slot; the upper surface of the brace defining a portion of the slot;

the at least one brace has a thickness and each of the lower ribs has a thickness; the thickness of the brace being less than the thickness of the lower ribs; and each of the lower ribs having an upper surface; the upper surface of a portion of the lower ribs cooperating with the brace to define a portion of the slot.

11. The system of claim 1, wherein the mat is a flow-through mat.

12. The system of claim 11, further comprising a section of hook fasteners connected to one of the mat and the strip and a section of loop fasteners connected to the other of the mat and the strip; the hook and loop fasteners providing the removable and re-attachable connection between the strip and the mat.

13. The system of claim 10, wherein the mat defines at least one drain opening adapted to allow liquid to drain out of the slot.

14. The system of claim 13, wherein the mat defines a plurality of drain openings adapted to allow liquid to drain out of the slot.

15. A floor mat system, comprising:

a mat having an upper surface;

at least one strip removably and re-attachably connected to the mat;

the mat defining a slot; the strip being at least partially disposed in the slot;

the mat including a plurality of spaced apart upper ribs disposed substantially parallel to the slot; a plurality of spaced apart lower ribs disposed substantially perpendicular to the slot; and at least one brace disposed substantially parallel to the slot; the upper surface of the brace defining a portion of the slot;

the at least one brace has a thickness and each of the lower ribs has a thickness; the thickness of the brace being less than the thickness of the lower ribs;

the mat defining a plurality of drain openings adapted to allow liquid to drain out of the slot; and the strip being disposed intermediate two drain openings when the strip is disposed in the slot.

16. The system of claim 15, wherein the strip has a first width; the slot having a second width; the second width being greater than the first width.

17. A floor mat system, comprising:

a flow-through mat having an upper surface; the mat having a plurality of upper ribs and a plurality of lower ribs;

the mat defining a plurality of slots; the lower ribs defining a portion of the slots;

the mat defining a plurality of flow-through openings intermediate each pair of slots;

a strip removably and re-attachably connected to the mat in each of the slots; and the mat defining at least one drain opening adapted to allow liquid to drain out of the slot.

18. The system of claim 17, wherein the mat defines a plurality of drain openings adapted to allow liquid to drain out of the slot.

19. The system of claim 17, wherein hook and loop fasteners provide the removable and re-attachable connection between the strips and the mat.

20. The system of claim 19, wherein the strip has a first width; the slot having a second width; the second width being greater than the first width.

21. The system of claim 17, wherein the mat includes a brace disposed under the strip; the brace having a lower surface; the mat having a lower surface; the lower surface of the brace being disposed above the lower surface of the mat.

22. The system of claim 17, wherein the mat is flexible.

23. The system of claim 22, wherein the strip is disposed intermediate two drain openings when the strip is disposed in the slot.

24. The system of claim 22, wherein the mat has upper and lower ribs.

25. The system of claim 24, wherein the upper and lower ribs are integrally molded together.

26. The system of claim 24, wherein the upper and lower ribs are extruded.

27. The system of claim 24, wherein the upper and lower ribs overlie each other and define the flow-through openings.

28. A floor mat system, comprising:

a flow-through mat having an upper surface;

the mat defining a plurality of slots;

a strip removably and re-attachably connected to the mat in each of the slots;

the mat defining at least one drain opening adapted to allow liquid to drain out of the slot;

the mat defining a plurality of drain openings adapted to allow liquid to drain out of the slot; and the strip being disposed intermediate two drain openings when the strip is disposed in the slot.

29. The system of claim 28, wherein the strip has a width; the slot having a second width; the second width being greater than the first width.

30. A floor mat system, comprising:

a flexible flow-through mat fabricated from non-metal intersecting upper and lower ribs;

the upper ribs being parallel and defining a plurality of slots;

the upper ribs defining a plurality of flow-through openings intermediate each pair of slots;

a strip removably and re-attachably connected to the mat in each of the slots;

each strip being removably and re-attachably connected to the mat with hook and loop fasteners;

braces that cooperates with the lower ribs and the upper ribs to define the slots; and the mat defining at least one drain opening adapted to allow liquid to drain out of the slot; each drain opening is disposed intermediate a brace and an upper rib.

31. The system of claim 30, wherein no portion of the mat overhangs the strip.

32. The system of claim 30, wherein the upper and lower ribs are integrally molded.

33. The system of claim 30, wherein the upper and lower ribs are extruded.

34. The system of claim 30, wherein the upper and lower ribs are fabricated from one of a rubber and a plastic.

* * * * *

UNITED STATES PATENT AND TRADEMARK OFFICE

CERTIFICATE OF CORRECTION

PATENT NO. : 6,663,937 B2
DATED : December 16, 2003
INVENTOR(S) : Ullman et al.

It is certified that error appears in the above-identified patent and that said Letters Patent is hereby corrected as shown below:

Column 8,
Line 48, change "The system of claim 1" to -- The system of claim 10 --.

Column 10,
Line 19, change the phrase "wherein the strip has a width" to read -- wherein the strip has a first width --.

Signed and Sealed this

Thirteenth Day of April, 2004

JON W. DUDAS
*Acting Director of the United States Patent and Trademark Office*